US012798627B2

(12) United States Patent
Rudolf et al.

(10) Patent No.: US 12,798,627 B2
(45) Date of Patent: Nov. 17, 2026

(54) TUBE TRANSPORT SYSTEM FOR VERY HIGH VEHICLE SPEEDS, A SPECIFIC TUBE ASSEMBLY TO ACHIEVE HIGH VACUUM, AND METHOD OF OPERATING A TUBE TRANSPORT SYSTEM

(71) Applicant: Alexander Rudolf, Kreuzlingen (CH)

(72) Inventors: Alexander Rudolf, Kreuzlingen (CH); Alain-Daniel Rudolf, Constance (DE)

(73) Assignee: Alexander Rudolf, Kreuzlingen (CH)

( * ) Notice: Subject to any disclaimer, the term of this patent is extended or adjusted under 35 U.S.C. 154(b) by 762 days.

(21) Appl. No.: 18/032,915

(22) PCT Filed: Oct. 26, 2021

(86) PCT No.: PCT/EP2021/079655
§ 371 (c)(1),
(2) Date: Apr. 20, 2023

(87) PCT Pub. No.: WO2022/090212
PCT Pub. Date: May 5, 2022

(65) Prior Publication Data

US 2023/0399030 A1 Dec. 14, 2023

(30) Foreign Application Priority Data

Oct. 26, 2020 (SA) ..... 120420159

(51) Int. Cl.
*B61B 13/10* (2006.01)
*B61B 13/12* (2006.01)

(52) U.S. Cl.
CPC ..... *B61B 13/10* (2013.01); *B61B 13/122* (2013.01)

(58) Field of Classification Search
CPC ..... B61B 13/10; B61B 13/08; B61B 13/122; B61B 1/02; B61B 13/00; Y02T 30/00; B60L 13/04; B60L 13/10
(Continued)

(56) References Cited

U.S. PATENT DOCUMENTS 1,020,942 A 3/1912 Bachelet
5,950,543 A 9/1999 Oster
(Continued)

FOREIGN PATENT DOCUMENTS

CN 101643071 A * 2/2010
CN 203974809 U 12/2014
(Continued)

OTHER PUBLICATIONS

PCT Notification of Transmittal of the International Search Report and the Written Opinion of the International Searching Authority, or the Declaration issued to counterpart Application No. PCT/EP2021/079655 dated Feb. 3, 2022.

*Primary Examiner* — S. Joseph Morano
*Assistant Examiner* — Heaven R Buffington
(74) *Attorney, Agent, or Firm* — McNees Wallace & Nurick LLC

(57) ABSTRACT

A method of operating a tube transport system having a tube assembly with an outer tube, one or more inner tubes, and a support structure, and a vehicle having an outer wall surface defining an annular gap between the outer wall surface of the vehicle and the inner wall of the tube assembly. The method includes moving the vehicle along a path toward a first end at a velocity above a choking limit of a flow of gas particles in the annular gap, while releasing gas particles from an inner space of the tube assembly in front of the vehicle, and reversing the direction of motion and moving the vehicle along the path toward a second end at a velocity above the
(Continued)

choking limit of the flow of the gas particles in the annular gap while releasing gas particles from the inner space of the tube assembly in front of the vehicle.

15 Claims, 3 Drawing Sheets

(58) Field of Classification Search
USPC ..... 104/138.1, 138.2, 155, 28
See application file for complete search history.

(56) References Cited

U.S. PATENT DOCUMENTS

| | | | | |
|---|---|---|---|---|
| 8,468,949 | B2 | 6/2013 | Kwon et al. | |
| 9,511,959 | B2 * | 12/2016 | Bambrogan | B63B 35/00 |
| 10,000,892 | B2 | 6/2018 | Oster | |
| 10,286,927 | B1 | 5/2019 | Neophytou et al. | |
| 10,286,928 | B1 | 5/2019 | Neophytou et al. | |
| 10,538,254 | B2 | 1/2020 | Grip et al. | |
| 2020/0001898 | A1 | 1/2020 | Neophytou et al. | |
| 2020/0239036 | A1 * | 7/2020 | Lee | B61B 13/00 |

FOREIGN PATENT DOCUMENTS

| | | | | | |
|---|---|---|---|---|---|
| CN | 105253150 | A | | 1/2016 | |
| CN | 105292135 | A | * | 2/2016 | |
| CN | 106080619 | A | | 11/2016 | |
| CN | 108583590 | A | | 9/2018 | |
| CN | 208411718 | U | * | 1/2019 | |
| CN | 108583590 | B | * | 6/2019 | B61B 13/10 |
| JP | S5073104 | | | 6/1975 | |
| JP | 2005119630 | A | | 5/2005 | |
| KR | 20120065141 | A | | 6/2012 | |
| KR | 101222043 | B1 | | 1/2013 | |
| WO | 2019162068 | A1 | | 8/2019 | |

* cited by examiner

Fig. 5
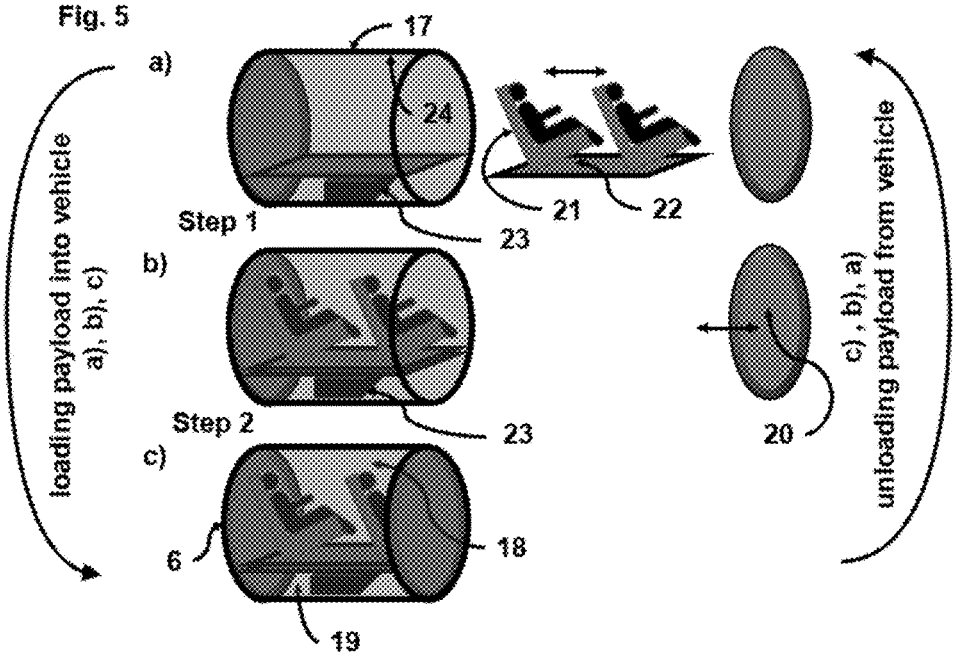
Fig. 6)
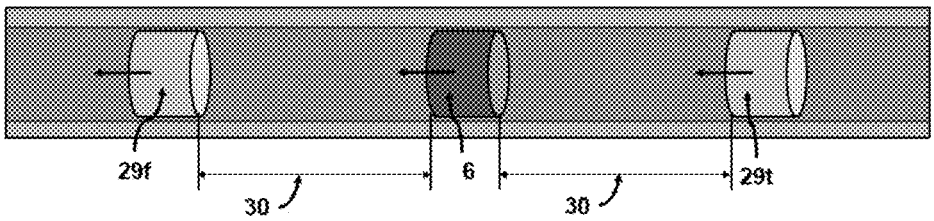
Fig. 7
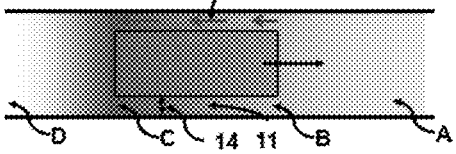
Fig. 8
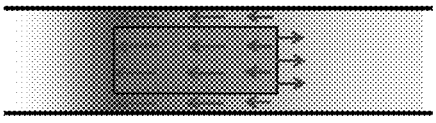
Fig. 9
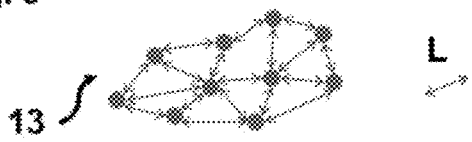
mean free path between fluid particles
$$Kn = L / D$$
L :: mean free path
D :: characteristic length

TUBE TRANSPORT SYSTEM FOR VERY HIGH VEHICLE SPEEDS, A SPECIFIC TUBE ASSEMBLY TO ACHIEVE HIGH VACUUM, AND METHOD OF OPERATING A TUBE TRANSPORT SYSTEM

FIELD OF THE DISCLOSURE

The present invention relates to a tube transport system for very high vehicle speeds and a method of operating such a system under high vacuum. Moreover, the present invention relates to a tube transport system comprising a specific tube assembly. The tube assembly is fit to operate as a stand-alone system above ground and, with adaptations, underground or inside a tunnel as well as under or above water.

BACKGROUND

High-speed tube transportation systems under partial vacuum or pneumatic systems have been in use and discussed for about 200 years. In 1799, George Medhurst proposed to move goods through steel pipes using pressurized air. In the 2nd half of the 19th century, several pneumatic railway systems have been operated in London, Dublin, New York, and Paris. In the beginning of the 20th century, the rocket scientist Robert Goddard designed a magnetically levitated train inside a sealed tunnel. A very serious attempt to realize such a system was the Swissmetro with a comprehensive study between 1989 and 1998. Due to political and fiscal priorities, this project was postponed. In 2012, Elon Musk issued a white paper with ideas of the Hyperloop® and reanimated the idea of a high-speed tube transportation system in a partial vacuum. The Hyperloop® is set up as an open source research project and attracted groups of scientists and business organizations to work on the best concept of a magnetic train in a partial vacuum. As far as is known, all these systems vehicles are operated with reduced drag in a sealed tube system under partial vacuum. The objective is to move passengers at high speed with short travel times.

In the most recent Hyperloop® concepts, the maximum velocity of the vehicle is believed to be physically or economically limited by the so-called "Kantrowitz Limit". This refers to the aerodynamic phenomenon where the flow in the annular gap between the vehicle and the tunnel reaches sonic speed, is hence said to be "choked". In order to increase the feasible vehicle speed, such systems operate in a partial vacuum with pressure levels as low as 100 Pa, i.e. the density is 1000 times smaller than under atmospheric pressure. As helium and hydrogen have a speed of sound of about 1000 m/s and 1300 m/s, respectively, it has been suggested to combine the employment of a low pressure and the use of helium, hydrogen or a mixture of these gases in the tube holding the vehicle as discussed in U.S. Pat. Nos. 10,286,927 and 10,286,928.

Further, the problem of friction between the rail and the wheel in high-speed tube transportation systems is often addressed by magnetic levitation as discussed e.g. in U.S. Pat. No. 1,020,942.

Despite such a long history, distinct technical approaches, and significant efforts, it is not known that such a high-speed tube transportation system has been realized. A major obstacle appears to be the aerodynamics. So far, the common understanding is that the vehicle speed cannot exceed the "Kantrowitz Limit" (this term is used to refer to the first occurrence of choking) and that reducing the pressure level below 100 Pa is economically not viable.

The method central for this invention is suitable and required to overcome these limitations. It is suggested to reduce the pressure level further so that a vehicle in an enclosed tunnel system moves with no aerodynamic resistance, i.e. when the Knudsen number exceeds unity.

While it is agreed that reducing and maintaining a high-vacuum is challenging, the aerodynamic problems of high-speed transportation in a partially evacuated tube is problematic. It appears that these problems have so far impeded the realization of such a system, even at the discussed low pressure levels around 100 Pa. In an attempt to reduce the far field aerodynamics, Rudolf (thesis 1806, EPFL, Switzerland, 1998) suggested the use of a turbine to push the air through the vehicle rather than having it flow around it and creating pressure waves. This idea has been reiterated in the white paper of Elon Musk from 2012 and in U.S. Pat. No. 9,511,959 from 2016.

If compared to other inventions in this field, it swaps the challenge of defying the aerodynamic under cruising conditions with the challenge to create and maintain a high vacuum efficiently. In return, the method rewards with the following advantages: no aerodynamic effects during cruising, reduced and well predictable loads on the tube system, smaller tunnel diameter, increased stability of the system, symmetrical arrangement of the entire system, reduced number of vacuum pumps and seals, no aerodynamic speed limit, smaller propulsion power, reduced travel times and smaller vehicles. Moreover, emergency exits and stations are possible with no leakages and short evacuation or exchange times.

The Hyperloop is a recent proposal for a high-speed vacuum tube transportation system which is suggested to operate at approximately 100 Pa of pressure as disclosed in general terms in U.S. Pat. Nos. 5,950,543 and 9,511,959. Evacuating the tube and maintaining the vacuum in the tube at a level below 100 Pa has apparently been found to be unviable, especially if the tube path has a length of hundreds of kilometers. The initial evacuation of the tube may entail a significant investment due to the required number of vacuum pumps, seals, control equipment and energy to achieve the required pressure level in the tube.

To maintain the pressure at the required level, all air entering the system by leakages must be evacuated. Leakages are a major concern in all evacuated tube transport systems, and it has not been shown so far that with the currently employed methods, the targeted pressure level of 100 Pa can be achieved for full-size Hyperloop test installations. In principle, commercially available vacuum pumps may be used to evacuate the tube. The number of vacuum pumps needed as well as the energy required depend upon the tube volume to be evacuated, the degree of vacuum to be achieved, the leakages and the time allotted to initially evacuate the tube volume.

Each seal of a vacuum pump, emergency exit, seam or door in the stations causes leakages, increasing with the tube diameter. A fundamental challenge in all current Hyperloop concepts is the number of seals required to separate the inside of the tube from ambient conditions.

U.S. Pat. No. 10,538,254 B2 addresses above problem by evacuating a tube for high-speed vacuum transportation systems with the vehicle only. If the vehicle is used to sweep particles, the number of expensive vacuum pumps and pressure seals is reduced. U.S. Pat. No. 10,538,254 B2 also contains measures that are more tolerant for the dimension of the gap between the inner surface of the tube and the exterior of a vacuum tube vehicle used to evacuate the tube. Accordingly, U.S. Pat. No. 10,538,254 B2 discloses a vacuum transport tube system and a method for evacuating a vacuum transport tube by a dedicated vehicle. The vehicle has a first end having a first end outer surface. An annular gap is formed between the first end outer surface and an inner surface of the vacuum transport tube. The vehicle has a second end having a second end outer diameter, and a body in the form of a piston with a structural framework. The vehicle has an orifice extending from a first inlet portion in the first end to a second outlet portion of the vehicle. Air flow is through the annular gap and the orifices from the front to the aft of the vehicle. The vehicle reduces the pressure with each successive pass by expanding the air in the zone behind the vehicle and extracting the compressed air from the tube, until a desired pressure is obtained, and the desired vacuum level is created in the interior of the tube.

The method of U.S. Pat. No. 10,538,254 B2 requires a dedicated wheel guided vehicle sweeping gas particles from the inner space of the tube. Moreover, it requires that gas particles flow from the front end orifice across the vehicle to the rear end orifice as well as through the annular gap between the vehicle and the inner wall of the tunnel in order to create a pressure difference between the space in front and rear of the vehicle. Its panels surrounding the vehicle can be dynamically are designed to adapt to non-uniformities in the tunnel diameter. The panels allow air to flow between the panels on an outer wall of the vehicle. The vehicle targets the creation of the required vacuum level in current Hyperloop projects, i.e. around 100 Pa, but it is not disclosed how this method can create a high vacuum. As the method requires flow from the front to the rear of the vehicle, a significant amount of gas particles will always remain inside the system. The method is therefore not suitable to reach a gas environment with Kn>1 and to reach vehicle speeds exceeding sonic speed of the gas mixture employed.

SUMMARY

The present disclosure discloses a particular method for creating and maintaining a high vacuum efficiently and to operate a vehicle in a tube system with very high speeds.

According to the first aspect, the present disclosure provides a method of operating a tube transport system, the tube transport system comprising (a) tube assembly comprising
- (a-1) an outer tube;
- (a-2) one or more inner tubes received and held in the outer tube so that an annular space is formed between adjacent tubes; and
- (a-3) a support structure for holding the outer tube;
- the tube assembly having an inner wall surface defining an inner space for receiving and guiding a vehicle along a path extending from a first end to an opposite second end of the tube assembly,
- the tube assembly having one or more pressure valves or nozzles for releasing gas particles from the inner space; and (b) a vehicle having an outer wall surface defining an annular gap between the outer wall surface of the vehicle and the inner wall of the tube assembly; the method comprising
- (i) moving the vehicle along the path toward the first end at a velocity above the choking limit of the flow of the gas particles in the annular gap, while releasing gas particles from the inner space of the tube assembly in front of the vehicle; followed by
- (ii) reversing the direction of motion and moving the vehicle along the path toward the second end at a velocity above the choking limit of the flow of the gas particles in the annular gap while removing gas particles from the inner space of the tube assembly in front of the vehicle.

According to the second aspect, the present disclosure provides a tube transport system comprising (a) tube assembly comprising
- (a-1) an outer tube;
- (a-2) one or more inner tubes received and held in the outer tube so that an annular space is formed between adjacent tubes; and
- (a-3) a support structure for holding the outer tube;
- the tube assembly having an inner wall surface defining an inner space for receiving and guiding a vehicle along a path extending from a first end to an opposite second end of the tube assembly,
- the tube assembly having one or more pressure valves or nozzles for removing gas particles from the inner space; and (b) a vehicle having an outer wall surface defining an annular gap between the outer wall surface of the vehicle and the inner wall of the tube assembly.

The method of the present disclosure is suitable to provide efficiently a high vacuum (pressure below 0.1 Pa) within the tube receiving and guiding a high-speed vehicle in the tube transport system. The tube transport system disclosed here provides efficient and safe transport of passengers or goods at velocities well above those being discussed so far in similar systems.

The use of
- the choking effect in the annular gap between the vehicle and the surrounding tube and
- several vested and aerodynamically corresponding tubes with radially decreasing pressure levels are proposed to reach the beforementioned objectives and are central aspects disclosed in this invention.

The use of the choking effect in the annular gap between the vehicle and the inner surface of the surrounding tube limits the flow around the vehicle and allows therefore to gather more fluid particles in the space between the front of the vehicle and the corresponding tube end, where they can be released or extracted efficiently at a high density. After several passes of the vehicle in both directions, a low pressure is reached in the inner tube. In this operational condition, all fluid particles passing the vehicle can be extracted via lateral openings and either stored inside the vehicle or expelled in front of the vehicle, where they can be compressed and released or extracted from the inner tube.

This method is essential and sufficient to reach and maintain the pressure level required to operate the vehicle free of friction. This is the case when the mean free path of the gas particles is longer than the width of the annular gap between the vehicle and the inner surface of the surrounding tube, i.e. when the Knudsen number is above unity (Kn>1) or the pressure is between 0.1 Pa and $10^{-7}$ Pa.

The present disclosure is based on the recognition that a high vacuum may be achieved within the tube transport system by making use of the choking effect in the annular gap between a vehicle and the inner surface of the inner tube. Once high vacuum is achieved, the Knudsen number is above unity and the vehicle moves free of friction. In addition, the present invention suggests to employ a system of vested tubes to allow a step-wise increase of the pressure from the inner tube to the outside. Both, the multi layered tube system and the use of the choking effect are central aspects of the tube transportations system and the method how it is used disclosed here.

Choked flow acts as a seal limiting the flow around the vehicle. As a result, gas ahead of the vehicle is compressed and gas behind the vehicle is expanded.

As long as the pressure in the inner tube is still high, choking occurs at relatively low speeds of the vehicle moving in a first direction. In this phase, air must be released or extracted from the pressure side to adjacent annular spaces. Repeating the step in the opposite second direction, and repeating the steps again provides a very low pressure level enabling efficient and safe transport at extremely high velocities using a vehicle of the present disclosure.

When the vehicle is cruising under high-vacuum with a very high speed, the choking effect allows to concentrate the few gas particles present in the inner tube at a location adjacent to the vehicle. Further, the chocking provides a determined flow condition in terms of velocity and density. In this phase, the choking effect can be efficiently used by extracting gas particles from the choked area into the vehicle and store it there.

The low pressure level is made possible and maintained based on a tube assembly having at least an annular space between an outer tube and an inner tube wherein a reduced pressure may be established and maintained, and which is in fluid flow communication with the inner space of the tube assembly for receiving gas particles released from the inner space.

The tube transport system of the present invention comprises a high-speed vehicle in a closed system operating under a vacuum, which is preferably using magnetic forces for guidance and propulsion. The tube transport system of the present invention operates at a very low pressure level, i. e. in an environment where the mean free path of the air particles is in the order of the characteristic dimensions of the vehicle, in particular the width of the annular gap. Accordingly, a Knudsen number is above unity at a pressure level of at most 0.1 Pa, preferably about 0.0001 Pa corresponding to the pressure in about 200 km altitude, which would eliminate the aerodynamic drag and allow substantially higher speeds up to the comfort levels.

BRIEF DESCRIPTION OF DRAWINGS

FIG. 2 b) shows schematically a vehicle moving in a tube transport system from second end to first end, according to an example embodiment.

FIG. 5 schematically displays a method of loading/unloading a payload into/from a vehicle, according to an example embodiment.

FIG. 6 shows an embodiment of a method of operating safety vehicles ahead and behind a passenger vehicle, according to an example embodiment.

FIG. 7 shows the condition of choked flow in an annular gap with a width, according to an example embodiment.

FIG. 8 displays an emergency braking method by expelling gas particles stored in a gas tank in front of a vehicle and creating choked flow in an annular gap, according to an example embodiment.

FIG. 9 shows gas particles moving freely in space, in which the gas particles travel a certain distance (free path) before colliding with another particle, according to an example embodiment.

DETAILED DESCRIPTION OF EXAMPLE EMBODIMENTS

Figure 1:
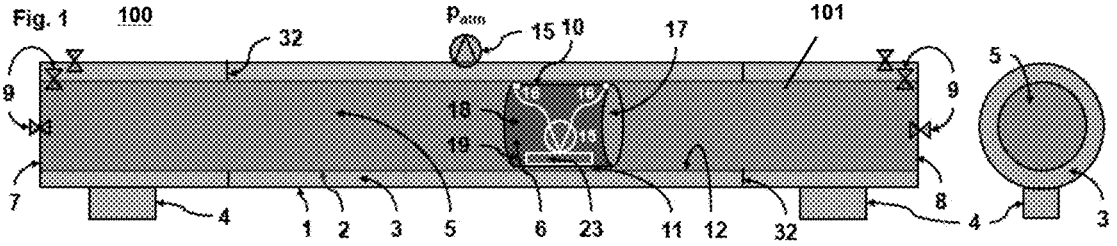
FIG. 1 shows schematically a tube transport system, according to an example embodiment.

In general, the Knudsen number is a dimensionless number defined as the ratio of the molecular mean free path length to a representative physical length scale. For the purpose of the present invention, the Knudsen number is defined as the ratio of the molecular mean free path length of the gas particles in the annular gap to the maximum width of the annular gap.

The mean free path L is determined according to the following formula:

$$L=\mu/p(\pi K_B T/2m)^{-1/2}$$

wherein $\mu$ is the dynamic viscosity, p is the density, $K_B$ is the Boltzmann constant, T is the thermodynamic temperature, and m is the molecular mass of the gas particle. For the purpose of the present invention, it is sufficient to determine the mean free path to a precision of 10 cm.

In the context of the present invention the ambient pressure outside the tube is the atmospheric pressure near sea level, i.e. about 100 kPa. High-vacuum is commonly referred to as pressure level of 0.1 Pa to $10^{-7}$ Pa.

The evacuated tube transport system in this present invention operates under high vacuum, preferably under pressure of $10^{-1}$ to $10^{-4}$ Pa. The process of compressing the air in front of one or more vehicles and releasing or extracting the air from there in several cycles is preparatory for the operating condition. The pressure level in the annular spaces formed by the vested tubes during normal operation is between ambient pressure and the high vacuum in the inner space. Before operating conditions are reached, the gas particles from the inner tube can be pushed from the inner tube to the adjacent annular spaces creating temporarily a pressure level above ambient pressure in the inner tube and the annular spaces.

The method of operating a tube transport system of the present invention foresees the use of the choking effect to efficiently and thoroughly compress air and to sweep remaining gas particles from the system. It is employed in the following stages of operating a tube transport system 1) when the pressure level of the tube receiving the vehicle is still above operational conditions and the tube is being evacuated and
2) when the tube receiving the vehicle is already evacuated and leakages require the continuous removal of gas particles while the vehicle is cruising with very high speed under operational conditions, i.e. high-vacuum.

The tube transport system comprises a tube assembly for receiving one or more vehicles. The tube assembly has an inner tube diameter which may be selected to be preferably at most 2.0 m, more preferably at most 1.5 m. The tube assembly comprises two or more layers with different pressure. In a double layer outer wall, a first inner tube is received within another slightly larger outer tube so that an annular space is created between the inner and outer tubes. The thickness of the walls of the tubes depends on the material used for the tubes and usually is independently selected in the range of from 1 cm to 10 cm, more preferably 2 to 5 cm. The width of the annular space may be in the range of from 1 cm to 20 cm, more preferably in the range of from 5 cm to 10 cm. Moreover, an inner space for transport is formed by the inner tube.

For operational conditions, the pressure level in the inner space used for transport will preferably be reduced 0.1 Pa to $10^{-4}$ Pa. The annular space surrounding the inner tube will maintain a pressure level of 10 Pa to 100 Pa, incidentally corresponding to the current operational pressure level of the Hyperloop®. If other annular spaces are present, their pressure is between the first annular space and ambient conditions.

The material of the tube is not particularly limited as long as the material has very low leakages, withstands the pressure differences and the forces due to the lateral acceleration of the vehicle and provides a satisfactory level of protection against external influences. Examples of the materials are aluminum, graphite fiber reinforced plastic (GFP), glass fiber reinforced concrete (GFC), magnesium, titanium or a combination of the beforementioned materials.

Without unduly obstructing the flow along each annular space, the annular spaces may be filled with a honeycomb or riblet structure or any bulk material, e.g. sand or small spheres between adjacent tubes for additional stiffness. The annular spaces may also be filed with a mixture of gases suitable to improve the maintenance of the high-vacuum in the inner tube, to support the evacuation process and improve the aerodynamic properties of the vehicle.

The complete tube assembly is connected via the outer tube to a support of an elevated guideway, a tunnel or a suspension below or above water. The inner tube contains electromechanical installations required to guide and propel the vehicle as well as sensors to ensure that any unusual operating condition is detected in an early stage. The connections between the tube wall and the external or internal installations must transfer the required forces and are designed to avoid leakage.

The method of the present invention comprises propelling and guiding the one or more vehicles in the tube, preferably at a maximum speed of at least 80 m/s while controlling the mean free path of any gas particles present in the tube to be longer than the annular gap by sweeping gas particles with the propelled one or more vehicles. More preferably, the maximum speed is at least 300 m/s, still more preferably the maximum speed of at least 1000 m/s.

The Method of Operating a Tube Transport System

The present invention relates to a method of operating a tube transport system. The method may be used for the transport of passenger or goods over a distance. Preferably, the distance is at least 5 km, more preferably at least 50 km. The maximum distance is not particularly limited as long as a suitable tube assembly may be provided. Accordingly, the distance may be up to 100 km, preferably up to 1000 km or even more.

The tube transport system comprises a tube assembly and one or more vehicles. The tube assembly is used for receiving and guiding the vehicle along a path.

The tube assembly comprises an outer tube. The outer tube is required to withstand atmospheric pressure when the inside is under vacuum.

The tube assembly comprises one or more inner tubes received and held in the outer tube so that an annular space is formed between adjacent tubes. According to the present invention, the tube diameter may be reduced to about 1.5 m and will preferably consist of a double layer outer wall (or one tube within another, slightly larger one). Both, the diameter and the double-layer wall contribute to a very solid and safe environment for the passenger vehicles.

The outer ring will maintain a pressure level of preferably about 100 . . . 1000 Pa and the pressure in the inner tube will preferably be reduced to 0.0001 Pa=$10^{-4}$ Pa.

The tube material must withstand the mentioned pressure differences and is also charged with the forces due to the lateral and longitudinal acceleration of the vehicle.

The one or more annular spaces are in fluid flow communication through control means such as valves, orifices or nozzles and pumps with the inner space so that fluid flow can be suppressed or maintained between annular spaces through the control means for creating a controlled pressure drop between adjacent annular spaces and the inner space, whereby the pressure in the annular spaces is between the ambient pressure and the pressure level in the inner space.

Preferably, the one or more inner tubes and/or the outer tube are made of aluminum, glass fiber reinforced plastic (GRP), glass fiber reinforced concrete (GFRC), carbon fiber, titanium, magnesium or any combination of these materials.

Preferably, the one or more annular spaces between the inner tube(s) and the outer tube contain a filling material partially filling the annular spaces while allowing fluid flow communication along the path.

The tube assembly comprises a support structure for holding the outer tube. The outer tube is connected to the support of an elevated guideway or a tunnel. The inner tube will contain the mechanical installations required to guide and propel the vehicle. The connections between the tube wall and the external or internal installations must transfer the required forces and are designed to avoid leakages.

The tube assembly having an inner wall surface defining an inner space for receiving and guiding a vehicle along a path extending from a first end to an opposite second end of the tube assembly.

The tube assembly having one or more pressure valves or nozzles for releasing gas particles from the inner space.

Preferably, the portion of the electro-magnetic guidance and propulsion system installed in the inner tube provides additional stability to the inner tube. This may be achieved by grouting the electric conductors, which are preferably flat, in artificial resin and then attach them over the full perimeter onto the inner surface of the inner tube.

Preferably, the portion of the electro-magnetic guidance and propulsion system installed on the vehicle provides additional stability to the vehicle body. In analogy to stiffening the tube, the electro-magnetic guidance and propulsion system may be grouted in artificial resin and then attached over the full perimeter of the vehicle hull.

Preferably, the portion of the electro-magnetic guidance and propulsion system installed in the inner tube is installed symmetrically alongside the tube to keep the vehicle in the center of the tube. This symmetric arrangement on the tube allows to use the available perimeter fully for powerful propulsion and guidance and stiffness.

Preferably, the portion of the electro-magnetic guidance and propulsion system installed on the vehicle is installed symmetrically alongside the vehicle to keep the vehicle in the center of the tube. This symmetric arrangement on the vehicle hull allows to use the available perimeter fully for powerful propulsion and guidance and stiffness.

The tube transport system further comprises a vehicle having an outer wall surface defining an annular spaces between the outer wall surface of the vehicle and the inner wall of the tube assembly.

Preferably, the vehicle comprises a cylindrical housing enclosing one or more compartments for payload (passengers or goods) and one or more service compartments, and having a releasable sealable port for accessing the passenger compartment.

Moreover, the passenger vehicle comprises one or more seats adapted to be removed from the passenger compartment for loading and unloading the passengers, which seats are adapted to be secured to the cylindrical housing in the passenger compartment when loaded with passengers.

Preferably, the vehicle further comprises one or more orifices in the annular gap space to extract gas particles alongside the vehicle for storage in a tank in the service compartment of the housing.

Preferably, the inner surface of the housing of the vehicle being equipped with a thin luminescent layer allowing the change of color and brightness or the display of a virtual reality, possible using hologram technology giving the passengers a 3-dimensional impression.

Preferably, the vehicle further comprises a system using flat surfaces for the generation of sounds and to transport verbal information or music to the passengers.

Preferably, the passenger seats can be actuated to increase comfort and driving experience. This refers to an actuation of the passenger seats to balance lateral acceleration and to adapt to the displayed virtual reality.

Preferably, the vehicle is equipped with facilities to open the housing from within and to release the passenger compartment from the housing in case of an emergency.

Preferably, the vehicle being equipped with a braking system using a gas cushion created by expelling stored gas particles.

Preferably, the vehicle being equipped with electrical equipment for propulsion and guidance.

Preferably, the vehicle being equipped with electrical equipment to transfer electrical energy by sliding contact or wireless from the outside to its inside and to store electrical energy.

The vehicle is preferably light as this is essential to reach top speeds with reasonable energy requirements. The very low pressure level and the elimination of the driving aerodynamics is the precondition for a light vehicle.

The vehicle does not require an aerodynamic form; it will preferably have a cylindrical shape with adaptations to the required technical equipment on-board. It may be split in an upper part for the payload, i.e. passengers or goods; whereby the lower part may be used for the electro-magnetic installations required for its propulsion. The extremities may contain additional technical equipment, such as vacuum pumps, the tools for the emergency brake and emergency exit. Additional installations for the guidance may be added along the vehicle at its outer wall.

Most of the space can be used for the payload, however, there are some features which need to be added to the vehicle, for which some space in the front or at its rear end may be foreseen.

It is not foreseen that the passengers, once seated, will get up and move inside the vehicle, except in case of an emergency for evacuation. Hence, the loading procedure will cover the following steps:

1. seating of the passengers,
2. displacing the seats into a cylindrical vehicle body,
3. closing the vehicle,
4. displacing the tunnel section loaded with the vehicle into the tube assembly.

Preferably, the tube transport system further comprises one or more vacuum pumps for creating and maintaining a vacuum level in an annular space of the tube assembly.

The method of the present invention comprises a step (i) of moving the vehicle along the path toward the first end at a velocity above the choking limit of the flow of the gas particles in the annular gap, while removing gas particles from the inner space of the tube assembly in front of the vehicle.

Subsequently, the method of the present invention comprises a step (ii) of reversing the direction of motion and moving the vehicle along the path toward the second end at a velocity above the choking limit of the flow of the gas particles in the annular gap while removing gas particles from the inner space of the tube assembly in front of the vehicle.

Preferably, the steps (i) and (ii) are repeated until the mean free path of the gas particles present in the tube assembly is longer than the width of the annular gap.

When the mean free path of the gas particles present in the tube assembly is longer than the width of the annular gap one or more vehicles may be propelled and guided in the tube assembly at a maximum speed of at least 80 m/s, preferably at least 300 m/s, and still more preferably at least 1000 m/s. Preferably, the vehicle is adapted to sweep gas particles from the annular gap of the tube assembly, preferably via lateral openings.

According to a preferred method of the present invention, vehicles are operated in pairs or in triplets so that ahead and/or behind of each passenger vehicle a safety vehicle is operated at a predetermined distance. Accordingly, the method comprises that the safety vehicles are preferably equipped with sensors and communication equipment to detect and report any unusual operating condition. Moreover, the method further comprises that the safety vehicle carries gas particles to help slowing down any of the vehicles in the case of an emergency situation. Moreover, the method further comprises that the safety vehicles is preferably equipped with pressure locks to separate the passenger vehicle from the remaining tube system. Finally, the method comprises the safety vehicles, preferably to carry luggage of the passengers.

Preferably, one or more vehicles are operated so that choking is achieved in the annular gap between the outer vehicle body and the inner surface of the inner tube.

Preferably, means are provided on the vehicles which can be used to extract the fluid particles from the annular space and to store them inside the vehicle body.

Preferably, means are fixed to the tubes which can extract the compressed air from the zone in front of a vehicle.

Preferably, the outer tube is provided with a surface sensitive to solar radiation creating energy at the outside of the outer tube. Moreover, means are preferably provided to gather and store the solar energy produced. Finally, means are preferably provided to reduce the $CO_2$ content of the air surrounding the tubes.

Preferably, the vehicle comprises a braking system using mechanical, magneto-electrical or aerodynamics means to slow down the vehicle, in particular by creating a flow around the vehicle with expelled gas particles formerly stored in the service compartment; and/or wherein the vehicle comprises electrical equipment for propulsion, guidance and braking.

The Tube Transport System

According to the present invention, the tube transport system comprises a tube assembly. The tube assembly comprises an outer tube, one or more inner tubes received and held in the outer tube so that an annular space is formed between adjacent tubes; and a support structure for holding the outer tube.

The tube assembly has an inner wall surface defining an inner space for receiving and guiding a vehicle along a path extending from a first end to an opposite second end of the tube assembly. The tube assembly has one or more pressure valves or nozzles for removing gas particles from the inner space.

The tube assembly further comprises a vehicle having an outer wall surface defining an annular gap between the outer wall surface of the vehicle and the inner wall of the tube assembly.

The tube assembly of the present invention is a multiple layer tube. One tube is vested in others or a tube with several wall layers is used to create multiple pressure levels between the atmosphere and the inner tube used for the circulation of the vehicle. As a default solution, only two tubes and pressure levels in the tube arrangement are used, but there may be solutions with 3 or more wall layers. A multi-layer tubular system may be used for a stepwise reduction of the pressure level from ambient to the inner tube. The pressure reduction may be achieved by extracting or adding liquid or fluid from or by circulating the liquid or fluid across nozzles, orifices or valves between the corresponding chambers of the tube.

A sandwich/honeycomb/riblet structure between the two tubes or outer tubes filled with a material, e.g. sand, suitable to protect the inner tube and to strengthen the multiple layer tube construction is contemplated. The outer rings of the tubes may be filled with sand, any other bulk material, riblets, sandwich or honeycomb material in order to protect the system against arson attacks from the outside (e.g. bullets, small explosives) and to improve the stiffness of the entire structure. This filling is distributed in a way that the fluid exchange along the tubes is not restrained, i.e. riblets have openings in radial direction, sand is coarse enough to allow the flow of fluids along the tubes.

The tubes may be filled with a mixture of Helium and Hydrogen or any other gas in order to improve the evacuation of the inner tube and the aerodynamic behavior of the vehicle.

It is expected that if the multiple tube system is filled with a mixture of Helium, Hydrogen and any other gas, the vacuum can be created or maintained better, leakages be reduced, and the remaining aerodynamic behavior of the vehicle improved. In this case, air might be exchanged with these gases.

A reduced pressure in the tube may be used to accelerate any type of object free of aerodynamic forces to reach very high speeds over a short distance.

A tube may be made with glass fiber reinforced plastic (GRP), glass, metal, concrete or carbon or a mixture of any of these materials. The tubes may be produced on or off site. In particular, a rig suitable to produce a seamless or fused tube with several layers with machines carrying and processing the material used to produce these tubes on site may be used.

The tube assembly may allow the opening of windows for an emergency exit anywhere along the tube. Installations on the tube required to prepare the creation of an emergency exit anywhere along the tube are contemplated. Moreover, a tube allowing the separation of a tube section to create a revolving station is also considered.

The present invention also contemplates installations on the tube required to prepare the airtight separation of a tube section from the rest of tube in order to prepare the exchange of a tube section as foreseen in the stations. Supports for the tubes and junctions between these supports and the tubes suitable to withstand the occurring forces and to maintain the vacuum with almost no leakages may be provided. The tubes may be equipped with solar panels either as an integral part of the tube or attached to produce energy which may be used for the operation of the vehicle.

The vehicle may be a light weight vehicle with a classical concept and a large diameter allowing the boarding and exiting of passengers via doors and an aisle the displacement of the vehicle into a tunnel section used as exchange.

The light weight vehicle may preferably be provided with a modular structure and a small diameter allowing the boarding and exiting of passengers on the seats, the displacement of the seated passengers into the vehicle, the airtight closure of the vehicle at its ends, and the displacement of the vehicle into a tunnel section used as exchange.

The vehicle may be provided with mechanical installations/pumps/turbines for the sweeping/extraction and compression of air. Mechanical installations for the exchange of collected air in the stations may also be provided. Pumps or turbines for the creation of an air cushion used as brake are also contemplated. Mechanical or electro-mechanical installations for the creation of eddy currents used as brake are disclosed. Tools and installations to be used to create an emergency exit are contemplated. A receiving device for energy transmission via laser or any other physically possible method is disclosed. For the brakes, installations on board of the vehicles suitable to create an air flow around the vehicle with the objective to slow down the vehicle at any given moment, mechanical brakes or electromagnetic brakes (eddy currents) may be used.

Conventional propulsion systems may be selected from linear induction motors as used in a Transrapid. However, superconducting magnets, railgun technology, laser energy transmission, photon or ion-based propulsion and the required energy transmission to the vehicle are also contemplated.

A conventional levitation system composed of active magnets like in the Transrapid with attracting force may be used. However, the levitation and guidance system may also be based on superconducting magnets. Suitable superconductor materials may be selected from bulk Yttrium Barium Copper Oxide (YBCO) crystals or vapor deposited YBCO films. Propulsion systems as disclosed in U.S. Pat. No. 10,000,892B2 may be adapted to the purpose of the present invention.

According to a preferred embodiment, guidance systems may be installed in 120° angles alongside the tube to keep the vehicle always in the center of the tube. This would also provide some margin for lateral movements.

According to a preferred embodiment, stations may be revolving barrel stations comprising mechanism to load and unload a complete tunnel segment in the station. A separation of the station tunnel segment from the rest of the tube with no or little leakages is preferred.

According to a preferred embodiment, the present invention allows to create an emergency exit anywhere along the tube, characterized by tools on board of the vehicle together with installations at the inside of the tubes are used to create an emergency exit at the incident location, which could be everywhere along the tube, whereby the tools may include a cutter or pyrotechnics with carbide or other.

According to a further preferred embodiment, the present invention allows an escape procedure/sequence to evacuate the passengers from the narrow space inside the tube to the open.

The vacuum technology for the creation and the maintenance of the required vacuum levels may involve the use of any type of pumps to reach and maintain the required pressure levels or suitable for an extraction and compression of fluid particles on board the vehicle, a discharge at the stations, the making use of the choking effect to compress and collect remaining fluid particles on board the vehicle.

According to a preferred embodiment, the present invention allows to guarantee the integrity of the system before and during each trip by closely monitoring with: vibration sensor, alignment sensors, pressure sensors, temperature sensors, and/or Cameras.

For the safety concept, the following is preferred: A safety vehicle preceding each passenger vehicle. A safety vehicle being used to carry the luggage of the passengers or any other goods or materials. An emergency stop system for the following passenger vehicle.

The present invention may be typically used as a long-distance transportation system.

The present invention will now be further illustrated with reference to the Figures.

FIG. 1 shows a tube transport system 100 for use in the method of the present invention. The tube transport system 100 comprises a tube assembly 101 and a vehicle 6.

The tube assembly 101 comprises an outer tube 1, and an inner tubes 2 received and held in the outer tube so that an annular spaces 3 is formed between the outer tube 1 and the inner tube 2. The tube assembly 101 further comprises a support structure 4 for holding the outer tube 1. The tube assembly 101 has an inner wall surface 12 defining an inner space 5 for receiving and guiding a vehicle 6 along a path extending from a first end 7 to an opposite second end 8 of the tube assembly. The tube assembly has one or more pressure valves or nozzles 9 for releasing gas particles from the inner space 5 and the annular spaces 3. A vacuum pump 15 is connected to the tube assembly 101 to extract gas particles from the annular space 3. The annular spaces are split longitudinally into compartments by the separators 32 extending from the outer surface of the inner tube 3 to the inner surface of the outer tube 1.

The vehicle 6 is represented in the form of a cylindrical housing 17 with an outer wall surface 10. The vehicle 6 contains a compartment designed to receive payload (passengers or goods) 18 and a service compartment 19. An annular gap 11 is formed between the outer wall surface of the vehicle 10 and the inner wall surface 12 of the tube assembly. A vacuum pump 15 is located inside the vehicle to extract gas particles from the annular gap 11 via lateral orifices 16; the gas particles can be stored in a tank 23 located in the service compartment 19.

Figure 2:
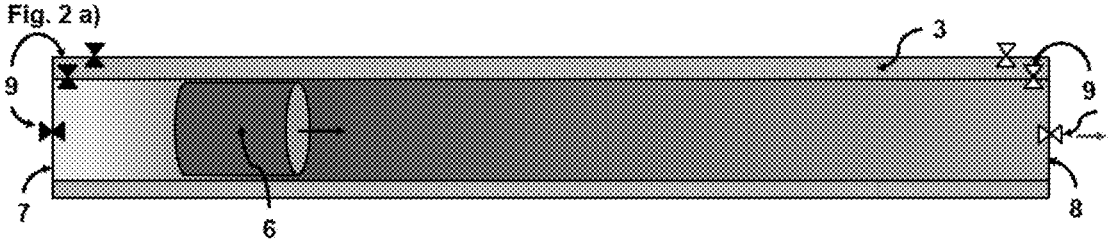
FIG. 2 a) shows schematically a vehicle moving in a tube transport system of from a first end to a second end, according to an example embodiment.
Figure 2:
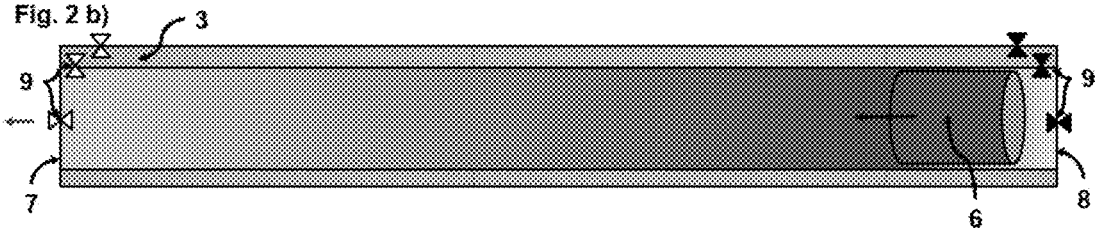

FIG. 2 a) shows a vehicle 6 moving from the first end 7 to the second end 8. Compressed gas particles are released via valve 9 on the second end 8 to the outside and to the annular space 3.

FIG. 2 b) shows a vehicle 6 moving from the second end 8 to the first end 7. Compressed gas particles are released via valve 9 on the first end 7 to the outside and to the annular space 3.

Figure 3:
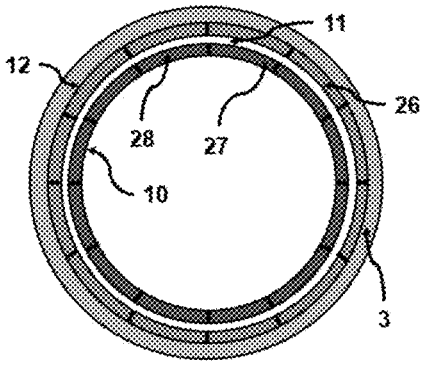
FIG. 3 shows schematically a cross section through a tube assembly in a tube transport system with electrotechnical installations used to guide and propel a vehicle, according to an example embodiment'.

FIG. 3 shows a cross section through the assembly 101 with the electrotechnical installations used to guide and propel the vehicle 6. The portion of the electro-magnetic guidance and propulsion system installed on the vehicle 27 and the electrical equipment to transfer electrical energy wireless 28 are displayed as an additional ring attached to the outer surface 10 of the vehicle. The portion of the electro-magnetic guidance and propulsion system installed on the inner tube 26 is displayed as a ring attached to the inner wall 12 of the tube assembly. The rings formed by the elements 26 and 27/28 enclose the annular gap 11.

Figure 4:
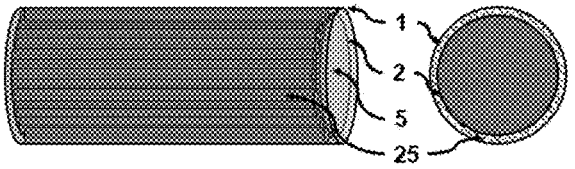
FIG. 4 shows schematically a tube assembly with an outer tube and an inner tube, according to an example embodiment.

FIG. 4 shows a tube assembly 101 with an outer tube 1 and an inner tube 2. Filling material 25 is positioned in the annular space between tubes 1 and 2. While filling material 25 is selected to provide additional stability to the tube assembly 101, it allows fluid flow inside the annular space from the first end 7 to the second end 8 of the tube assembly. In FIG. 4, the filling material 25 is composed of perforated tubes connected to the outer surface of the inner tube and the inner surface of the outer tube.

FIG. 5 displays the method of loading/unloading the payload 22 into/from the vehicle 6. FIG. 5 a) shows the situation where the lid 20 is open and the payload 22 is outside of the cylindrical housing 17 of the vehicle 6. In step 1, the payload (here: the passengers) are displaced from the outside of the vehicle into the passenger compartment 18 of the vehicle 6 with the result displayed in FIG. 5 b). FIG. 5 c) displays the vehicle after step 2 has been completed. In step 2, the lid 20 is displaced onto one end of the vehicle so that the vehicle is completely sealed. To unload the passengers from the vehicle, the above described steps are passed through in the opposite order, i.e. first the lid is removed from the vehicle and then the payload.

FIG. 6 displays the method of operating safety vehicles 29 ahead and behind the passenger vehicle 6. The distance 30 between the preceding safety vehicle 29 and the passenger vehicle 6 is chosen so that it is always possible to slow down the passenger vehicle without colliding with the safety vehicle 29*f* if it detects any irregular condition. The trailing safety vehicle 29*t* follows in a safe distance. The safety vehicles are equipped with sensors and tools to split the inner space 5 longitudinally into sections.

FIG. 7 displays the condition of choked flow in the annular gap 11 with a width 14. If a vehicle 6 moves in the inner tube 5 with gas particles, the gas particles will be compressed in front (A) of the vehicle 6 and expansion will occur in the rear (D) of the vehicle 6. The so created pressure difference between the front (A) and the rear (D) of the vehicle induces flow in the annular gap 11 from the front end of the vehicle (B) to the rear end of the vehicle (C). Depending on the pressure level, the width of the annular gap 14 and the diameter of the inner tube 5, the flow against the driving direction in the annular gap reaches sonic speed, when the vehicle exceeds a certain speed. This phenomenon is called choking. When the flow is choked, the mass flow can no longer be increased, hence more gas particles will be pushed to the front. This invention makes use of the choking effect in order to sweep gas particles to the front of the vehicle where they can be released via valves or nozzles 9.

In FIG. 8 an emergency braking method by expelling gas particles stored in the gas tank 23 in front of the vehicle. The sudden increase of gas particles in front of the vehicle 6 induces a flow around the vehicle in the annular gap 11 in opposite direction to the driving direction. When the velocity is high and sufficient gas particles can be released, the flow in the annular gap is choked, which increases the pressure in front of the vehicle further. This method will slow down the vehicle.

FIG. 9 displays gas particles moving freely in space, the gas particles traveling a certain distance before they collide with another particle. This distance is averaged for all gas particles in a particular volume and over a particular time period defining the so called mean free path.

Figure 10:
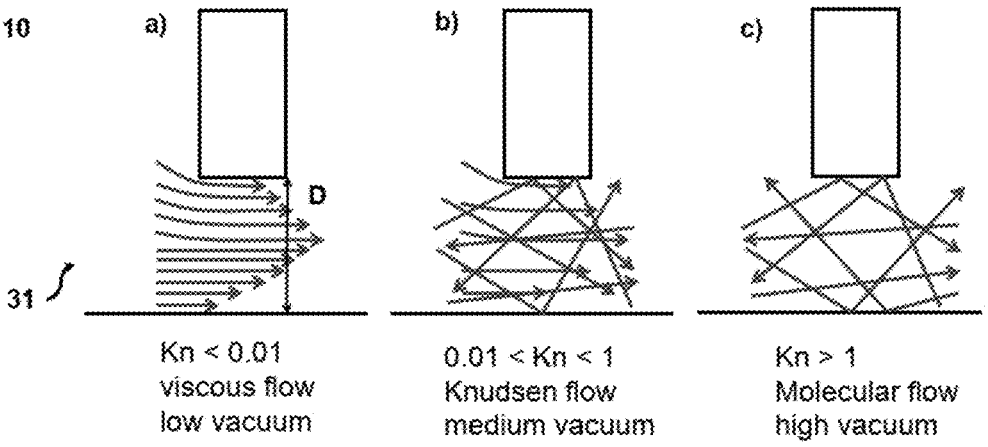
FIG. 10 shows three different flow regimes relevant in the context of the present disclosure.

FIG. 10 shows 3 different flow regimes relevant for the invention.

FIG. 10 a) shows viscous flow as it is described by the classical fluid dynamics, where the fluid is considered a continuum and the Navier-Stokes equations apply for viscous flow.

FIG. 10 b) displays the transition regime, the so called Knudsen flow, in which some gas particles behave like a continuum and others experience no significant mutual interaction.

In FIG. 10 c) all gas particles move freely in space. In this so-called molecular flow, the gas particles experience no friction. This flow is sought for normal cruising operation is this invention.

LIST OF REFERENCE NUMERALS

1: outer tube
2: inner tube
3: annular space between adjacent tubes (e.g. outer and inner tube)
4: support structure for holding the outer tube
5: inner space
6: vehicle
7: first end of tube assembly
8: second end of tube assembly
9: valve
10: outer wall surface of vehicle
11: annular gap
12: inner wall of the tube assembly
13: mean free path of the gas particles
14: width of the annular gap
15: vacuum pump
16: one or more orifices in the annular gap
17: cylindrical housing of vehicle
18: compartment designed to receive payload
19: one or more service compartments
20: releasable sealable port for accessing the passenger compartment
21: actuation of the passenger seats
22: payload, i.e. passenger seats or goods fixed on a removable support structure
23: gas tank
24: inner surface of the passenger compartment
25: filling material
26: portion of the electro-magnetic guidance and propulsion system installed on the inner tube
27: portion of the electro-magnetic guidance and propulsion system installed on the vehicle
28: electrical equipment to transfer electrical energy by sliding contact or wireless
29: flow of the gas particles in the annular gap . . .
29': safety vehicle
30: predetermined distance between passenger and safety vehicle
31: visualization of Knudsen number Kn
32: compartmentation of the annular space

The invention claimed is:

1. A method of operating a tube transport system, the tube transport system comprising:

(a) a tube assembly comprising:

(a-1) an outer tube;

(a-2) one or more inner tubes received and held in the outer tube so that annular spaces are formed between the outer tube and the one or more inner tubes; and (a-3) a support structure for holding the outer tube;

wherein the tube assembly has an inner wall surface defining an inner space for receiving and guiding a vehicle along a path extending from a first end to an opposite second end of the tube assembly, wherein the tube assembly has one or more pressure valves or nozzles for releasing gas particles from the inner space; and (b) one or more vehicles having an outer wall surface defining an annular gap between the outer wall surface of the vehicles and the inner wall surface of the tube assembly;

the method comprising:

(i) moving one of the vehicles in one direction along the path toward the first end at a velocity above a choking limit when a flow of the gas particles in the annular gap reaches sonic speed, while releasing gas particles from the inner space of the tube assembly via the one or more pressure valves or nozzles in front of the vehicle; and (ii) reversing a direction of motion and moving the vehicle along the path toward the second end at a velocity above the choking limit while releasing gas particles from the inner space of the tube assembly via the one or more pressure valves or nozzles located in front of the vehicle.

2. The method of operating a tube transport system according to claim 1, wherein steps (i) and (ii) are repeated until a mean free path of the gas particles present in the tube assembly is longer than the width of the annular gap.

3. The method of operating a tube transport system according to claim 2, further comprising propelling and guiding one or more vehicles in the tube assembly until a pressure in the inner tube is $10^{-4}$ Pa or less, at a maximum speed of at least 80 m/s more.

4. The method of operating a tube transport system according to claim 1, wherein the tube transport system further comprises one or more vacuum pumps for creating and maintaining a vacuum level in an annular space of the tube assembly, wherein gas particles can be swept from the annular gap between an outer vehicle surface and the inner tube via lateral openings in a hull of the vehicle, which are adapted to sweep gas particles into the vehicle and to store the gas particles in a service compartment of the vehicle, where the gas particles can later be used to supply oxygen to passengers or to create choked flow around the vehicle to slow down a vehicle in case of an emergency.

5. The method of operating a tube transport system according to claim 1, wherein the one or more annular spaces are in fluid flow communication through a control device so that fluid flow can be suppressed or maintained between annular spaces through the control device for creating a controlled pressure drop between adjacent annular spaces and the inner space, whereby the pressure in the annular spaces is between an ambient pressure and a pressure level in the inner space.

6. The method of operating a tube transport system according to claim 1, wherein:

the one or more inner tubes and/or the outer tube are made of glass fiber reinforced plastic (GRP), glass fiber reinforced concrete (GFRC), carbon fiber, aluminum, titanium, magnesium or any combination of these materials;

the one or more annular spaces contain a filling material partially filling the annular space while allowing fluid flow along the annular space and the one or more annular spaces are split in a longitudinal direction relative to the path by separators forming hydraulically separated and sealed spaces.

7. The method of operating a tube transport system according to claim 1, wherein the vehicle further comprises:

(b-1) a cylindrical housing enclosing one or more passenger compartments and one or more service compartments, and having a releasable sealable port for accessing the passenger compartment; and (b-2) one or more seats adapted to be removed from the passenger compartment for loading and unloading the passengers, in which seats are adapted to be secured to the cylindrical housing in the passenger compartment when loaded with passengers.

8. The method of operating a tube transport system according to claim 1, wherein the vehicle further comprises:

(b-3) one or more orifices in a vehicle hull to extract gas particles alongside the vehicle from the annular gap for storage in a tank in a service compartment of a housing;

(b-4) an inner surface of a passenger compartment being equipped with a thin luminescent layer allowing a change of color and brightness or a display of a virtual reality including a use of hologram technology giving the passengers a 3-dimensional impression while traveling;

(b-5) an installation of a sound system;

(b-6) an actuation of a passenger seat to increase comfort and driving experience;

(b-7) the vehicle being equipped with facilities to open the housing from within and to release the passenger compartment from the housing in case of an emergency;

(b-8) the vehicle being equipped with a braking system using a gas cushion created by expelling stored gas particles;

(b-9) the vehicle being equipped with electrical equipment for propulsion and guidance; and (b-10) the vehicle being equipped with electrical equipment to transfer electrical energy by sliding contact or wireless from an outside to an inside of the vehicle and to store electrical energy.

9. The method of operating a tube transport system according to claim 1, wherein:

a portion of an electro-magnetic guidance and propulsion system installed in the inner tube provides additional stability to the inner tube;

a portion of the electro-magnetic guidance and propulsion system installed on the vehicle provides additional stability to the vehicle body;

a portion of the electro-magnetic guidance and propulsion system installed in the inner tube is installed symmetrically alongside the inner tube to keep the vehicle centered in the inner tube such that the annular gap between the vehicle outer wall and the surface of the inner tube is almost constant over the tube perimeter; and a portion of the electro-magnetic guidance and propulsion system installed on the vehicle is installed symmetrically alongside the vehicle to keep the vehicle in the center of the tube.

10. The method of operating a tube transport system according to claim 1, wherein:

the vehicles are operated in pairs or in triplets so that ahead or behind of each passenger vehicle a safety vehicle is operated at a predetermined distance, the safety vehicles are equipped with sensors and communication equipment to detect and report any unusual operating condition;

the vehicles carry gas particles stored under pressure which can be expelled in front of the vehicles in a driving direction to help slow down any of the vehicles in case of an emergency situation by causing choking in the annular gap;

the vehicles are equipped with pressure locks, which consist of inflatable material located in a service compartment and are released in front and in rear of the vehicle sealing a complete section of the inner tube in an airtight manner to separate releasing vehicle aerodynamically from a remaining tube system in case of an emergency; and the safety vehicles carries luggage of the passengers.

11. The method of operating a tube transport system according to claim 1, the method comprising:

(i) operating multiple vehicles so that choking is achieved in the annular gap between an outer vehicle surface and the inner wall surface of the inner tube;

(ii) extracting gas particles from the annular gap storing the gas particles inside the vehicle body via a device on the vehicles; and (iii) extracting a compressed air from a zone in front of a vehicle via a device fixed to the tubes.

12. The method of operating the tube transport system according to claim 1, the method comprising:

(i) creating energy at the outside of the outer tube on a surface sensitive to solar radiation;

(ii) gathering and storing a solar energy produced; and (iii) adsorbing $CO_2$ from the ambient air surrounding the tubes.

13. The method of operating the tube transport system according to claim 1, wherein the vehicle comprises a braking system using mechanical, magneto-electrical or aerodynamics devices to slow down the vehicle, wherein the vehicle comprises electrical equipment for propulsion, guidance and braking.

14. The method of operating a tube transport system according to claim 13, wherein a maximum speed is at least 300 m/s.

15. The method of operating a tube transport system according to claim 13, wherein a maximum speed is at least 1000 m/s.

* * * * *